US005360243A

United States Patent [19]

Hirsh

[11] Patent Number: 5,360,243

[45] Date of Patent: Nov. 1, 1994

[54] CHILD SAFETY LOCK APPARATUS

[76] Inventor: Sydney Hirsh, 146 B130 St., Rockaway Park, N.Y. 11694

[21] Appl. No.: 65,394

[22] Filed: May 24, 1993

[51] Int. Cl.[5] ..... E05C 1/06

[52] U.S. Cl. ..... 292/144

[58] Field of Search ..... 292/144, 251.5, 341.16, 292/DIG. 60, DIG. 65, DIG. 58

[56] References Cited

U.S. PATENT DOCUMENTS

| | | | |
|---|---|---|---|
| 947,866 | 2/1910 | Taylor | 292/144 |
| 2,130,559 | 9/1938 | Papp | 292/144 |
| 2,146,968 | 2/1939 | Macagno | 292/144 |
| 2,205,712 | 6/1940 | Bitgood | 292/144 |
| 2,786,701 | 3/1957 | Povlich | 292/144 |
| 2,828,151 | 3/1958 | Brotman et al. | 292/DIG. 65 |
| 4,277,094 | 7/1981 | Roue | 292/144 X |

*Primary Examiner*—Peter M. Cuomo
*Assistant Examiner*—Jerry Redman
*Attorney, Agent, or Firm*—E. Michael Combs

[57] ABSTRACT

A latch structure arranged for use with cabinets and the like is arranged to include a remote treadle operated switch housing arranged to effect selective actuation of an electromagnetic member to effect disengagement of a latch member. The latch member includes a latch housing having a slide rod, with the slide rod having a slide rod head for selective ferromagnetic attraction to the electromagnetic member to disengage the latch member.

3 Claims, 4 Drawing Sheets

CHILD SAFETY LOCK APPARATUS

BACKGROUND OF THE INVENTION

1. Field of the Invention

The field of invention relates to latch structure, and more particularly pertains to a new and improved child safety lock apparatus wherein the same is directed for the remote actuation requiring a predetermined poundage to effect actuation of the organization.

2. Description of the Prior Art

Latch structure of various types have been utilized in the prior art such as exemplified in the U.S. Pat. Nos. 4,925,257; 4,048,050; 4,697,306; 4,286,809; and 4,111,505.

The prior art has heretofore employed various safety latch structure but wherein the instant invention attempts to overcome deficiencies of the prior art by directing the latch structure for continuous engagement prior to the closure of a remote switch, wherein the remote switch requires a predetermined poundage such as eighty pounds minimum to effect disengagement of the latch structure relative to an associated cabinet and in this respect, the present invention substantially fulfills this need.

SUMMARY OF THE INVENTION

In view of the foregoing disadvantages inherent in the known types of lock apparatus now present in the prior art, the present invention provides a child safety lock apparatus wherein the same is arranged to prevent disengagement of the lock structure prior to closure of a switch member requiring a predetermined poundage for operation. As such, the general purpose of the present invention, which will be described subsequently in greater detail, is to provide a new and improved child safety lock apparatus which has all the advantages of the prior art safety lock structure and none of the disadvantages.

To attain this, the present invention provides a latch structure arranged for use with cabinets and the like arranged to include a remote treadle operated switch housing arranged to effect selective actuation of an electromagnetic member to effect disengagement of a latch member. The latch member includes a latch housing having a slide rod, with the slide rod having a slide rod head for selective ferromagnetic attraction to the electromagnetic member to disengage the latch member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved child safety lock apparatus which has all the advantages of the prior art safety lock apparatus and none of the disadvantages.

It is another object of the present invention to provide a new and improved child safety lock apparatus which may be easily and efficiently manufactured and marketed.

It is a further object of the present invention to provide a new and improved child safety lock apparatus which is of a durable and reliable construction.

An even further object of the present invention is to provide a new and improved child safety lock apparatus which is susceptible of a low cost of manufacture with regard to both materials and labor, and which accordingly is then susceptible of low prices of sale to the consuming public, thereby making such child safety lock apparatus economically available to the buying public.

Still yet another object of the present invention is to provide a new and improved child safety lock apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
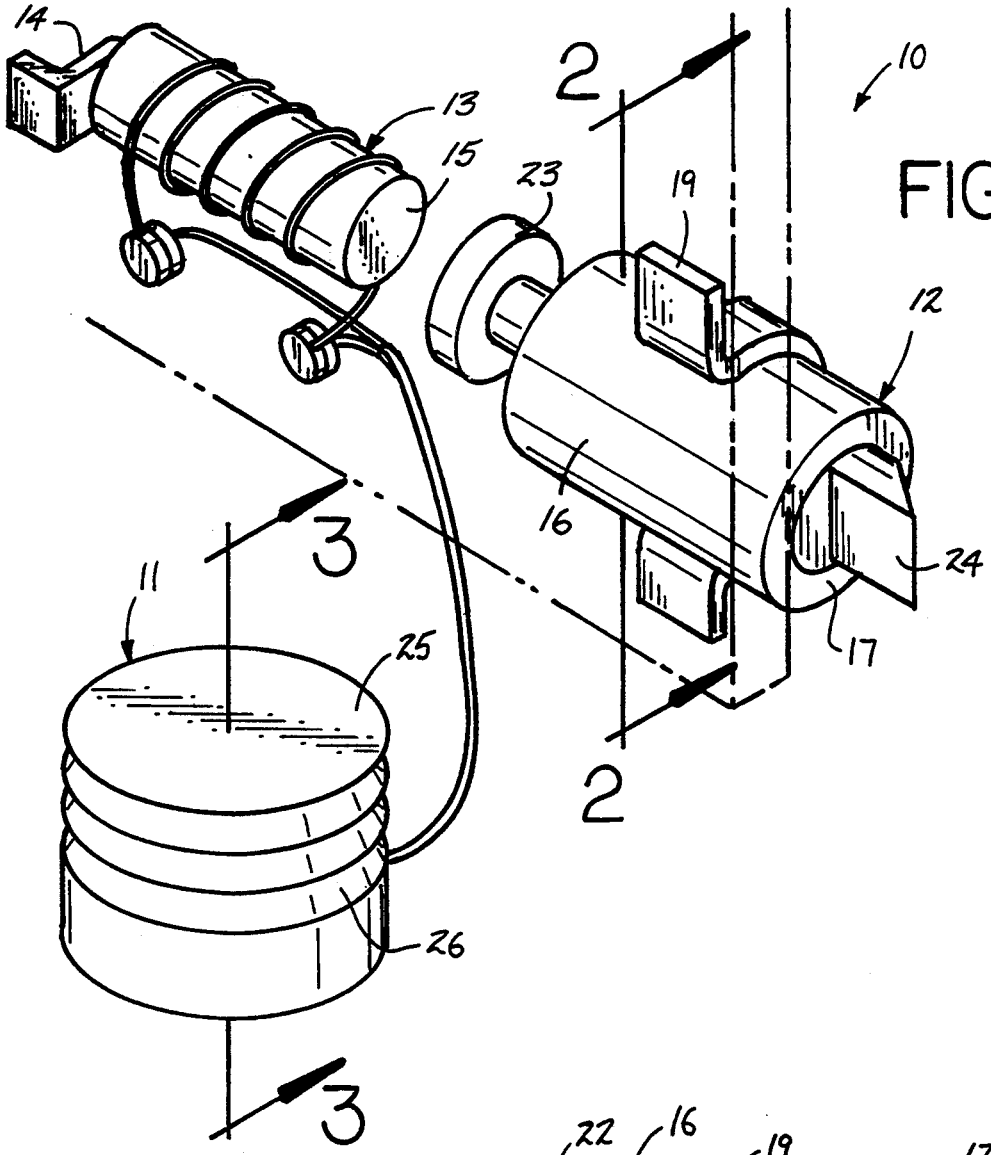
FIG. 1 is an isometric illustration of the invention.

With reference now to the drawings, and in particular to FIGS. 1 to 8 thereof, a new and improved child safety lock apparatus embodying the principles and concepts of the present invention and generally designated by the reference numeral 10 will be described.

More specifically, the child safety lock apparatus 10 of the instant invention essentially comprises a switch housing 11 arranged to effect disengagement of a latch member 12 through an electromagnetic member 13. The electromagnetic member 13 includes an electromagnetic member support bracket 14 mounted to the electromagnetic member for securement to an associate cabinet structure (not shown), with a forward end 15 of the electromagnetic member 13 arranged in a coaxially aligned facing relationship relative to the latch member 12. The latch member 12 is configured with a latch housing cylinder 16 coaxially aligned relative to the electromagnetic member 13. A housing cylinder is arranged having a first end wall 17 spaced from a second end wall 18, with the second end wall 18 arranged in a parallel relationship relative to the electromagnetic forward end 15. A housing cylinder mounting bracket 19 is provided also to permit selective securement of the latch member 12 to an associated cabinet structure in any desired manner utilizing whatever fastening structure or adhesives as desired.

Figure 2:
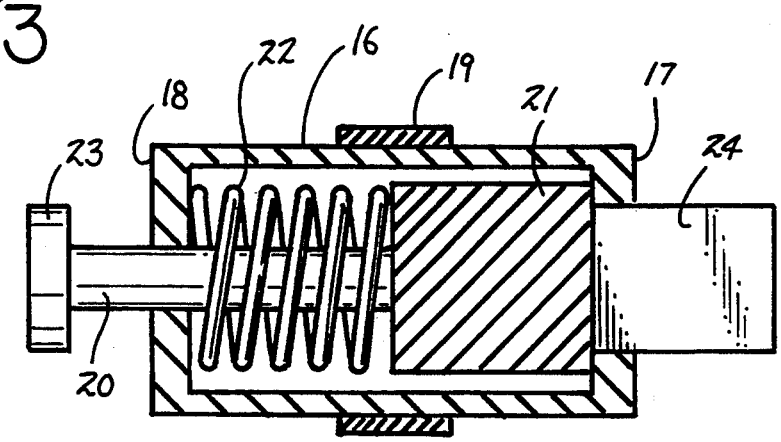
FIG. 2 is an orthographic view, taken along the lines 2—2 of FIG. 1 in the direction indicated by the arrows.
Figure 3:
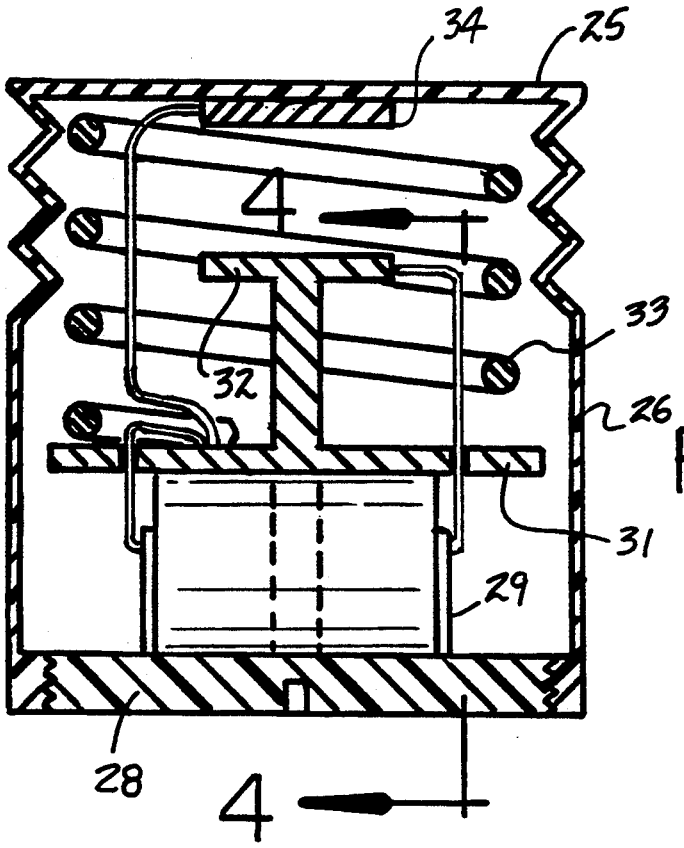
FIG. 3 is an orthographic view, taken along the lines 3—3 of FIG. 1 in the direction indicated by the arrows.
Figure 4:
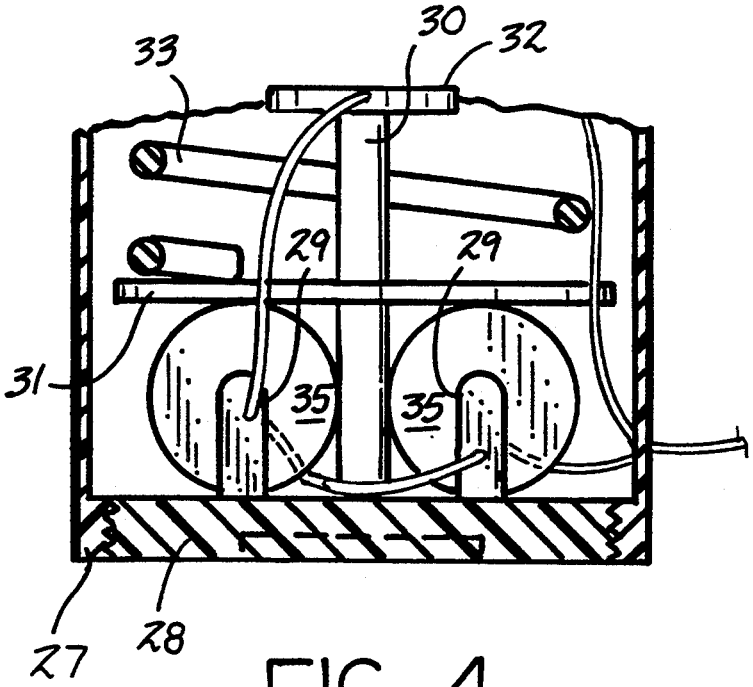
FIG. 4 is an orthographic view, taken along the lines 4—4 of FIG. 3 in the direction indicated by the arrows.

A slide rod 20 is coaxially directed through the latch housing cylinder 16, and more specifically through the second end wall 18, having an abutment block 21 mounted fixedly to the slide rod 20 between the slide rod 20 and the first end wall 17 within the latch housing cylinder 16. A slide rod spring 22 is captured between the abutment block 21 and the first end wall 17 within the latch housing cylinder 16, as illustrated, to normally bias the abutment block 21 and an associated latch plate 24 that is slidably and orthogonally directed through the first end wall 17 permitting the biasing from the slide rod spring 22 to project the latch plate 24, in a manner as illustrated in FIG. 2. The slide rod 20 is formed with a slide rod head 23 fixedly mounted in an orthogonal relationship relative to the slide rod at an outermost distal end thereof in a facing parallel relationship relative to the electromagnetic member forward end 15, whereupon actuation of the electromagnetic member 13 effects ferromagnetic attraction of the slide rod head 23 that at least is formed of a ferrous magnetically adherable material.

The switch housing 11 is formed with a switch housing top wall 25 and a side wall 26 having a flexible pleated construction to permit projection of the switch housing top wall 24 towards the switch housing bottom wall 27 in a parallel relationship. A bottom wall insert 28 is removably mounted such as by threaded disengagement, as illustrated in the FIGS. 3 and 4, within the switch housing bottom wall 27. The insert 28 is arranged to include a battery holder bracket or a plurality of such brackets 29 arranged to mount battery members 35 that are arranged for selective actuation of the electromagnetic member 13. A support post 30 is orthogonally and fixedly mounted to the insert 28 within the switch housing, and the support post includes a first plate 31 fixedly mounted to the support post in an orthogonal relationship parallel and spaced relative to the insert 28 to provide for positioning of the battery holder brackets 29 between the first plate 31 and the insert 28. A second plate 32 oriented parallel and in a spaced relationship relative to the first plate 31 is arranged between the first plate 31 and the switch housing top wall 25. The first plate 31 is arranged of a first width, with the second plate 32 having a second width substantially less than the first width such that a switch spring 33 is captured between the switch housing top wall 25 and the support post first plate 31. The switch housing top wall 25 includes a top wall contact plate 34 arranged in a facing relationship relative to the second plate 32 such that compression of the top wall 25 towards the second plate 32 effects closure of the switch and electrical communication of the batteries 35 with the electromagnetic member 13 to effect electromagnetic attraction to the slide rod head 23.

Figure 5:
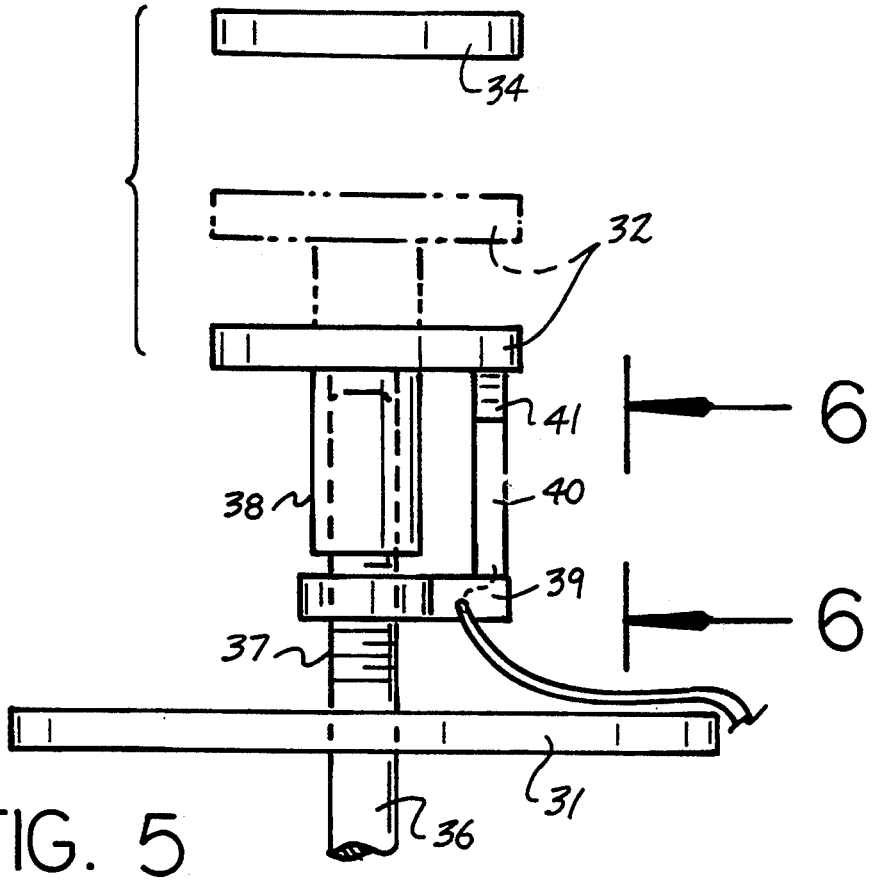
FIG. 5 is an orthographic view of a modified rod structure within the switch housing.
Figure 6:
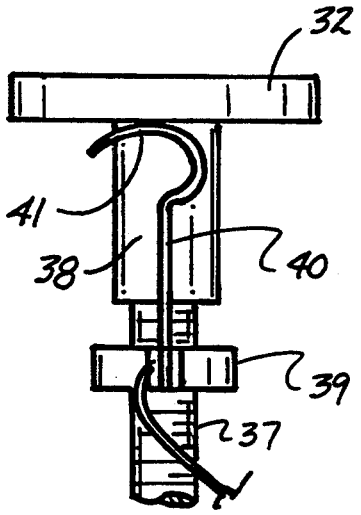
FIG. 6 is an orthographic view, taken along the lines 6—6 of FIG. 5 in the direction indicated by the arrows.

The FIGS. 5 and 6 indicates the use of a modified support post 36 having a threaded post end portion 37 positioned between the first plate 31 and the second plate 32 to receive a second plate internally threaded socket tube 38 in an adjustable relationship to provide for selective spacing of the second plate 32 relative to the contact plate 34. Electrical communication with the battery members 35 is effected by a collar 39 arranged for threaded mounting about the modified support post 36 having a contact leg 40 orthogonally and fixedly mounted to the collar, with the contact leg 40 having a contact leg spring contact plate 41 arranged in biased engagement with the second plate 32. It should be understood that a collar 39 is formed of an electrically insulative material such that electrical communication between the battery 35 and the contact leg 40 and associated contact leg spring 41 is not grounded by the collar 39.

Figure 7:
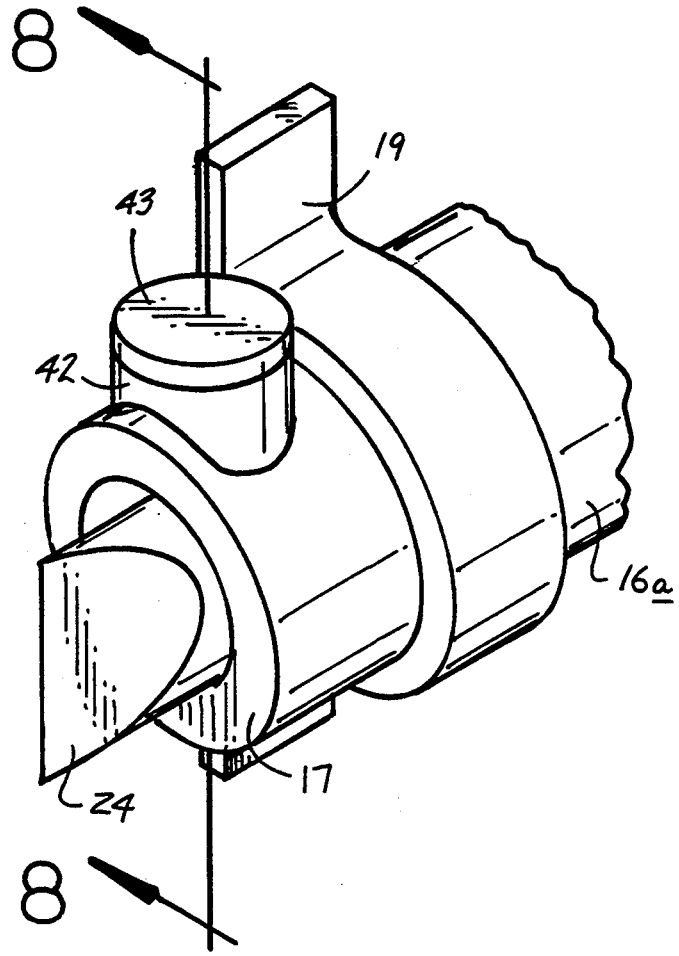
FIG. 7 is an isometric illustration of a modified latch housing structure.
Figure 8:
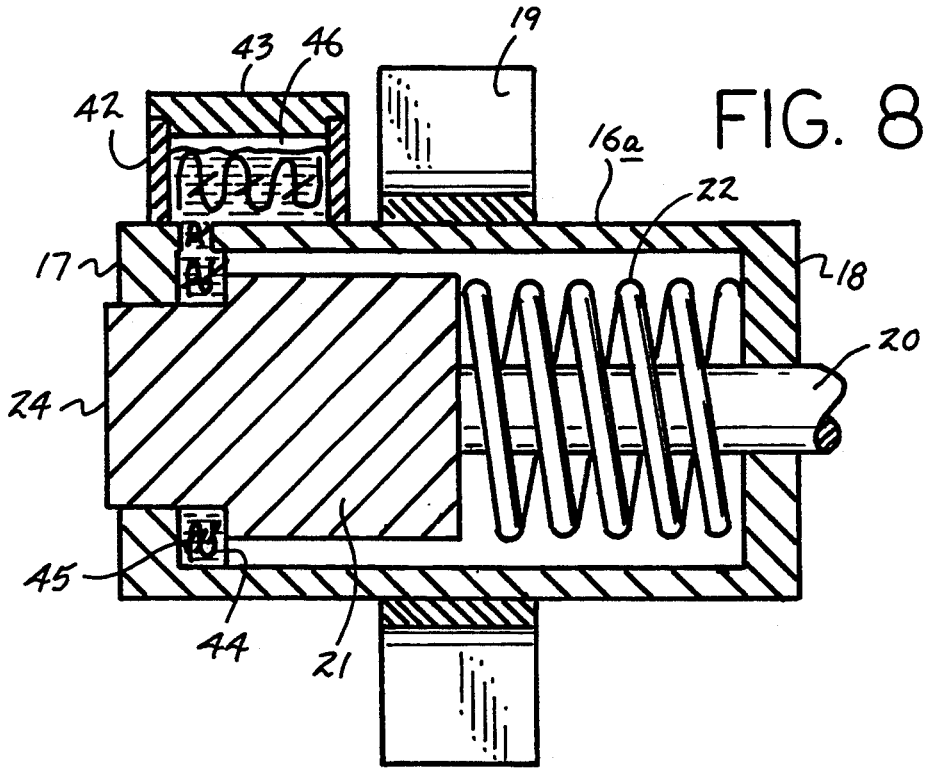
FIG. 8 is an orthographic view, taken along the lines 8—8 of FIG. 7 in the direction indicated by the arrows.

The FIGS. 7 and 8 indicates the use of a lubricant reservoir housing 42, having a housing cap 43 removably mounted therefrom to permit replenishment of fluid within the reservoir cavity 46. A flexible membrane 44 of an annular configuration is arranged in surrounding relationship relative to the latch plate 24 between the first end wall 17 and the abutment 21. A fluid lubricant impregnated compressible wick 45 is positioned between the flexible membrane 44 and the first end wall 17 such that upon biased compression and projection of the abutment block 21 to the first end wall 17, lubricant is extracted from the compressible wick structure 45 to direct lubricant relative to the latch plate 24 to maintain its ease of sliding through the first end wall 17.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A child safety lock apparatus, comprising, a switch housing, a latch member, and an electromagnetic member, and the switch housing arranged in electrical communication with the electromagnetic member, with the electromagnetic member arranged in a coaxially aligned orientation relative to the latch member, the latch member including a latch housing, with the latch housing including a slide rod, and actuation of the electromagnetic member through the switch housing effects displacement of the slide member relative to the latch housing, and the latch housing includes a latch housing first end wall spaced from a latch housing second end wall, the slide rod slidably directed through the second end wall and directed into the latch housing, wherein the slide rod includes an abutment block fixedly and orthogonally mounted to the slide rod within the latch housing, with the slide rod arranged for projection to the first end wall, with the abutment block having a latch plate slidably directed through the first end wall, and a slide rod spring interposed between the second end wall and the abutment block within the latch housing effects biasing of the abutment block to the second end wall and projection of the latch plate through the second end wall, and the slide rod includes a slide rod head fixedly mounted to the slide rod exteriorly of the latch housing between the second end wall and the electromagnetic member, whereupon actuation of the electromagnetic member effects ferromagnetic attraction of the slide rod head to the electromagnetic member, and the switch housing includes a switch housing top wall, a flexible switch housing side wall, and a switch housing bottom wall, the bottom wall including a bottom wall insert removably mounted relative to the bottom wall, with at least one battery holder mounted to the insert within the switch housing, and a support post fixedly and orthogonally mounted to the insert within the switch housing, the support post including a first plate fixedly and orthogonally mounted to the support post within the switch housing spaced from the insert, and a second plate mounted to the support post between the first plate and the switch housing top wall, the second plate having a second width, with the first plate having a first width, with the second width less than the first width, and a switch spring captured between the switch housing top wall and the first plate to bias the switch housing top wall in a spaced relationship relative to the second plate, and a top wall contact plate mounted to the top wall within the switch housing in facing relationship relative to the second plate and biased relative to the second plate, with the second plate and the contact plate positioned within the switch spring.

2. An apparatus as set forth in claim 1 wherein the support post includes a threaded post end portion and the second plate having an internally threaded socket arranged for receiving the threaded post end portion therewithin permitting axial adjustment of the second plate relative to the first plate, and an electrically insulative collar mounted to the support post between the second plate and the first plate, and the collar having a contact leg, the contact leg including a spring contact plate in contiguous engagement with the second plate and in electrical communication with the battery member.

3. An apparatus as set forth in claim 2 including a fluid reservoir housing mounted to the latch housing, and a flexible membrane of annular configuration in positioning between the first end wall and the abutment block, and a lubricant fluid impregnated compressible wick extending from the reservoir housing in surrounding relationship about the latch plate between the first end wall and the abutment block in communication with the latch plate.

* * * * *